US009809045B2

(12) United States Patent
Raeburn

(10) Patent No.: US 9,809,045 B2
(45) Date of Patent: Nov. 7, 2017

(54) HANDS-FREE, PORTABLE WORK SURFACE

(71) Applicant: James Raeburn, Oviedo, FL (US)

(72) Inventor: James Raeburn, Oviedo, FL (US)

( * ) Notice: Subject to any disclaimer, the term of this patent is extended or adjusted under 35 U.S.C. 154(b) by 229 days.

(21) Appl. No.: 14/215,773

(22) Filed: Mar. 17, 2014

(65) Prior Publication Data

US 2014/0346201 A1 Nov. 27, 2014

Related U.S. Application Data

(60) Provisional application No. 61/792,017, filed on Mar. 15, 2013.

(51) Int. Cl.
*B42F 9/00* (2006.01)

(52) U.S. Cl.
CPC ..... *B42F 9/001* (2013.01)

(58) Field of Classification Search
CPC ..... B42F 9/00; B42F 9/001; A45F 2004/023
USPC ..... 224/578
See application file for complete search history.

(56) References Cited

U.S. PATENT DOCUMENTS 2,701,173 A * 2/1955 Senior ..... A45F 5/00 108/43
2,876,022 A * 3/1959 Kroviak ..... B42F 9/001 108/43
4,243,249 A * 1/1981 Goss ..... B42F 9/001 108/43
4,264,049 A * 4/1981 Daniels ..... F16M 13/04 248/444
4,750,657 A * 6/1988 King ..... B43L 5/02 224/220
4,903,932 A * 2/1990 Stewart, Jr. ..... A45F 5/00 224/267
4,988,229 A * 1/1991 Ramsey, III ..... B42F 13/40 281/43
5,823,500 A * 10/1998 La Coste ..... B43L 3/008 248/444
5,862,933 A * 1/1999 Neville ..... A47B 23/002 108/43
6,364,183 B1 * 4/2002 Barnard ..... A45F 5/00 108/43
6,734,842 B2 * 5/2004 Woodmansee ..... G06F 1/163 345/169
D650,531 S * 12/2011 Young ..... D29/120.1
2014/0265298 A1 * 9/2014 Cooper ..... B42F 9/001 281/45

* cited by examiner

*Primary Examiner* — Brian D Nash
(74) *Attorney, Agent, or Firm* — Allen Dyer Doppelt & Gilchrist

(57) ABSTRACT

A hands-free portable work surface includes a rigid work surface substrate and a strap connected thereto. The strap extends away from the work surface at two points along a perimeter thereof, and is routed along the perimeter of the work surface between the two connection points.

4 Claims, 2 Drawing Sheets

HANDS-FREE, PORTABLE WORK SURFACE

CROSS-REFERENCE TO RELATED APPLICATION

This application claims the benefit of U.S. Non-Provisional Application Ser. No. 61/789,101, filed on Mar. 15, 2013, the contents of which are herein incorporated by reference in their entirety.

FIELD OF THE INVENTION

The present invention relates to mechanical supports for work surfaces, and more particularly, to supports that can be worn by the user.

BACKGROUND OF THE INVENTION

One well known example of a portable work surface is a clipboard. As the name suggests, a clipboard includes a clip allowing a user to secure papers or the like thereto. The rigidity of the clipboard allows the user to readily write on the secured papers, and its portability allows it to be carried about and used in locations where there is no readily available desk or other support surface.

Frequent users of clipboards include watchstanders in power plants or other industrial facilities, coaches, doctors, etc. Notably, such users are ordinarily making only brief annotations on their clipboards, which limited use is partially driven by limitations of the clipboard, itself. Most particularly, unless a desk or some other surface is nearby, the user must support the clipboard with one hand while writing with the other. This can quickly become uncomfortable.

The same limitations apply to more modern work surfaces, such as tablet computers. While such devices offer superior functionality relative to a clipboard in many respects, a user away from a desk or other support must hold the device in one hand while working with the other.

In some instances, users have attached a strap to the top of clipboard. While a strap will certainly prevent the user from having to put the clipboard down between uses, it is still necessary for the user to hold the clipboard while actively using it.

SUMMARY OF THE INVENTION

In view of the foregoing it is an object of the present invention to provide a hands-free, portable work surface. These and other objects, aspects and advantages of the present invention will be better appreciated in view of the drawings, and following detailed description of preferred embodiments.

DETAILED DESCRIPTION OF PREFERRED EMBODIMENTS

Figure 1:
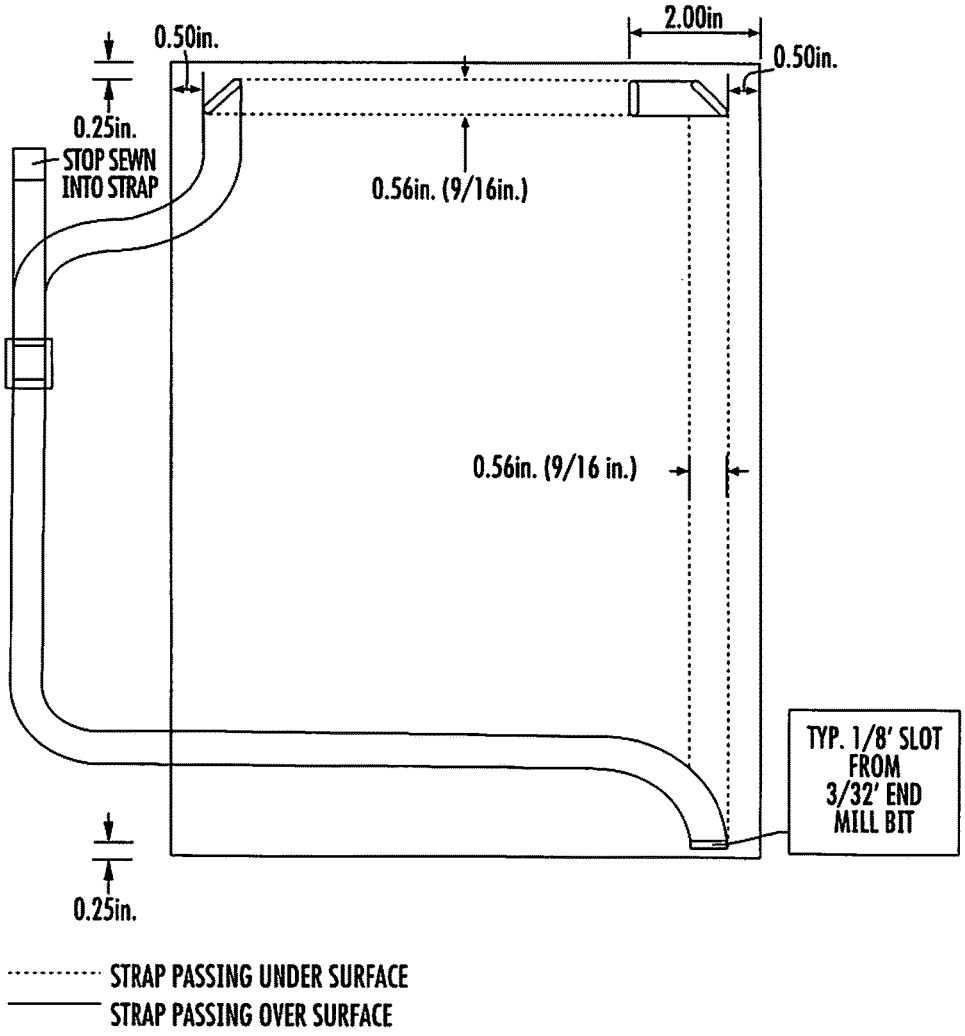
FIG. 1 is a schematic top view of a hands-free, portable work surface, according to an embodiment of the present invention.

Referring to FIG. 1, according to an embodiment of the present invention, a hands-free portable work surface includes a rigid work surface substrate with a strap connected thereto. The strap extends away from the work surface at two points along the perimeter thereof, preferably the two connection points having the greatest straight-line distances therebetween, and is routed along the perimeter of the work surface between the two connection points.

For a rectangular work surface, as is shown in FIG. 1, this means that the two connection points are located at diagonally opposed corners of the surface, and that the strap is routed between the two connection points between a third corner intermediate the two diagonally opposed corners. More particularly, with reference to the substrate orientation shown in FIG. 1, the strap is routed from a first of the diagonally opposed corners, across a top edge of the substrate to the intermediate corner, and then down a side edge of the substrate to the second of the diagonally opposed corners. The term "free edge" is used herein to denote any portion of the perimeter of the substrate along which the strap is not routed. Advantageously, the strap is routed under the majority of the top edge and side edge, although the present invention is not necessarily limited to such a routing.

Opposite ends of the strap are preferably connected at an adjustment buckle, such that the strap forms a complete loop. The adjustment buckle permits the loop to be lengthened or shortened depending on the size and preferences of the user. The strap could also include a neck pad or the like for increased comfort. The term "strap" should be not be understood as limited to a particular type of strap material, such as a webbed strap, but to broadly encompass any materials that can interface with the substrate as described herein. Some non-limiting examples include cords, ribbons, chains and tubes.

Referring to FIGS. 2A-2D, during use of the work surface, the strap is looped over one shoulder and under the other shoulder of the user. Preferably, the strap is placed under the shoulder corresponding to the dominant hand. In order to write on, or otherwise utilize, the work surface in a hands-free mode, the user places a free edge of the work surface against the front of the user's person (preferably around waist level, but alternately at any other height the user is comfortable with). When so worn, the strap acts to keep the work surface from flipping when pressure is applied to the top thereof.

Figure 2A:
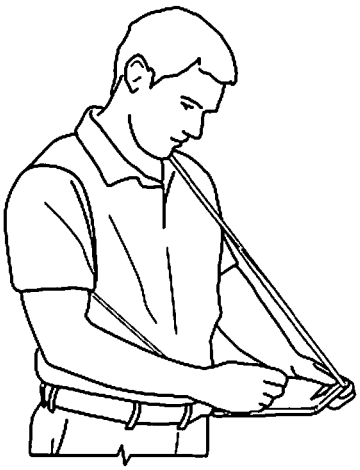
FIGS. 2A-2D illustrate various modes of use of the hands-free, portable work surface of FIG. 1.
Figure 2B:
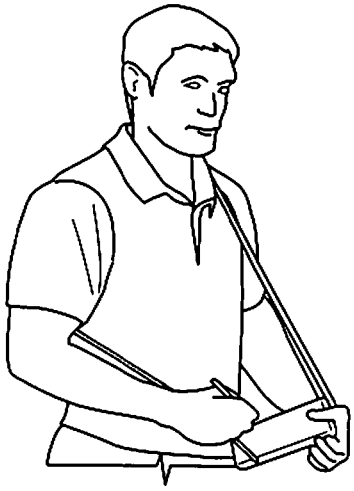
Figure 2C:
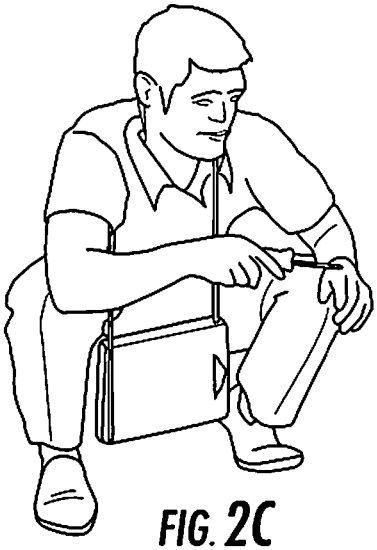
Figure 2D:
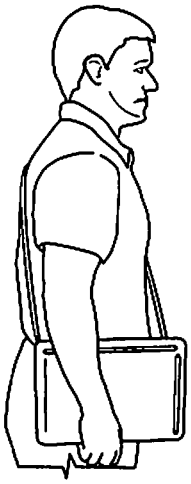

For a rectangular work surface, as in FIGS. 1 and 2A-2D, the user has the option of placing a short free edge against his or her person (portrait mode—FIG. 2A) or a long free edge (landscape mode—FIG. 2B). When use of the work surface is not desired, the work surface can either be hung in front (or in back) of the user (pendant mode—FIG. 2C) or to the side (transport mode—FIG. 2 D).

Although the depicted work surface includes a rectangular board as a substrate, the present invention is not necessarily limited thereto. For example, boards of other shapes could used while applying the same principles enumerated above. Additionally, substrates other than boards could be used. For instance, a tablet computer, or a holder therefore, could be used a substrate.

In the depicted embodiment, the strap is advantageously routed through openings formed in the substrate. Alternately, the strap could be routed through eyelets, staples or the like attached along the perimeter of the substrate. Other attachments also could beneficially be added to the substrate unconnected with the strap, such as storage compartments, hooks, clips, holders for writing implements, etc.

The foregoing is not an exclusive list of possible variations. Rather, those skilled in the art will appreciate that these and other modifications, as well as adaptations for particular circumstances, will fall within the scope of the invention as herein shown and described and of the claims appended hereto.

What is claimed is:

1. A hands-free portable work surface comprising:

a rigid work surface substrate having a perimeter extending along first, second, third and fourth edges, the first and fourth edges meeting at a first corner, the first and second edges meeting and a second corner, the second and third edges meeting at a third corner, and the third and fourth edges meeting at a fourth corner; and a strap connected to the substrate;

wherein the strap extends away from the work surface at the first and third corners thereof, and is routed along the first and second edges of the work surface through the second corner.

2. The hands-free work surface of claim 1, wherein the strap forms a complete loop.

3. The hands-free work surface of claim 2, wherein the third and fourth edges of the work surface are both free edges along which the strap is not routed.

4. A method of using the hands-free work surface of claim 3, comprising:

placing the strap over one shoulder and under another shoulder of a user; and placing one of the free edges against a front of the user.

* * * * *